US006604363B2

(12) United States Patent
Corey et al.

(10) Patent No.: US 6,604,363 B2
(45) Date of Patent: Aug. 12, 2003

(54) MATCHING AN ACOUSTIC DRIVER TO AN ACOUSTIC LOAD IN AN ACOUSTIC RESONANT SYSTEM

(75) Inventors: John A. Corey, Melrose, NY (US); Jerry Martin, Superior, CO (US)

(73) Assignees: Clever Fellows Innovation Consortium, Troy, NY (US); Mesoscopic Devices, Broomfield, CO (US)

( * ) Notice: Subject to any disclaimer, the term of this patent is extended or adjusted under 35 U.S.C. 154(b) by 0 days.

(21) Appl. No.: 10/126,596

(22) Filed: Apr. 19, 2002

(65) Prior Publication Data

US 2002/0178736 A1 Dec. 5, 2002

Related U.S. Application Data

(60) Provisional application No. 60/285,465, filed on Apr. 20, 2001.

(51) Int. Cl.[7] ..... F25B 9/00
(52) U.S. Cl. ..... 62/6
(58) Field of Search ..... 62/6; 60/520

(56) References Cited

U.S. PATENT DOCUMENTS 4,114,380 A 9/1978 Ceperly
4,355,517 A 10/1982 Ceperly
4,398,398 A 8/1983 Wheatley et al.
4,489,553 A 12/1984 Wheatley et al.
4,858,441 A 8/1989 Wheatley et al.
4,953,366 A 9/1990 Swift et al.
5,139,242 A 8/1992 Yarr
5,146,123 A 9/1992 Yarr
5,303,555 A 4/1994 Chrysler et al.
5,389,844 A 2/1995 Yarr et al.
5,953,920 A * 9/1999 Swift et al. ..... 62/6
5,996,345 A 12/1999 Hofler
6,079,214 A * 6/2000 Bishop ..... 62/6
6,353,987 B1 3/2002 Corey

* cited by examiner

*Primary Examiner*—Ronald Capossela
(74) *Attorney, Agent, or Firm*—Hoffman, Warnick & D'Alessandro LLC; Spencer K. Warnick

(57) ABSTRACT

A method for matching an acoustic load and an acoustic driver in a resonant acoustic system, and the acoustic system so formed. The load and driver may be independently designed. The invention provides, inter alia, a matching volume positioned between the acoustic driver and load that is substantially greater than a stroke volume of the driver. The matching volume is sized such that, in combination with the moving mass, the characteristic stiffness of the acoustic driver and the characteristic load impedance, a resulting pressure wave produces an operating resonant frequency substantially equal to the preferred operating frequency of the load. Alternatively, or in addition thereto, a stroke volume of the acoustic driver can be adjusted.

20 Claims, 1 Drawing Sheet

MATCHING AN ACOUSTIC DRIVER TO AN ACOUSTIC LOAD IN AN ACOUSTIC RESONANT SYSTEM

This application claims priority to U.S. provisional patent application No. 60/285,465, filed Apr. 20, 2001 under 35 U.S.C. §119(e).

BACKGROUND OF THE INVENTION

1. Technical Field

The present invention relates generally to acoustic resonant systems, and more particularly, to a method of matching an acoustic driver to an acoustic load in an acoustic resonant system, and the system so formed.

2. Related Art

Acoustic resonant systems, such as high-frequency, "Stirling-style" pulse tube cryocoolers, are often powered by an acoustic driver such as a linear-motor-driven, resonant compressor. These compressors must be operated close to their resonant frequency in order to obtain high efficiency. Simply achieving resonant conditions at the compressor is insufficient, however, since several other matching conditions must also be met for a practical machine.

In general, for independently designed acoustic drivers and loads, only some of these matching conditions will be satisfied, resulting in inferior performance. Depending on which parameters are considered fixed, it is likely that the design frequency for the load will differ from the resonant frequency of the complete system, or full acoustic power will be delivered at a stroke other than rated stroke. If full acoustic power is delivered at less than rated stroke, excessive driver current will be required. If full rated power is delivered at more than rated stroke, the machine will be stroke-limited and never achieve its designed cooling capacity.

In view of the foregoing, there is a need in the art for a method for matching independently designed acoustic loads and acoustic drivers, and an acoustic system so formed.

SUMMARY OF THE INVENTION

Historically, designers have tried to make the combined acoustic driver and load as small as possible. In order to accomplish this, a stroke volume of the driver and any other volume between the driver and load has been minimized as much as possible. The invention, however provides, inter alia, a matching volume positioned between the acoustic driver and load that is substantially greater than a stroke volume of the driver. The matching volume is such that an operating resonant frequency substantially equal to a preferred operating frequency of the acoustic load is achieved. The invention, hence, allows for independent design of an acoustic driver and load. As an alternative, or in addition to the sizing of the matching volume, the stroke volume may be sized such that, in combination with a moving mass and a characteristic stiffness of the acoustic driver and a characteristic load impedance, a resulting pressure wave delivers a preferred input acoustic flow amplitude to the load when the acoustic driver is operating at the operating resonant frequency, the preferred stroke, and the preferred force amplitude.

A first aspect of the invention is directed to a method for matching an acoustic driver to an acoustic load in a resonant acoustic system, the acoustic driver including a moving mass, a characteristic stiffness, a preferred force amplitude, and a preferred stroke; the acoustic load including a characteristic load impedance, a preferred input acoustic flow amplitude, and a preferred operating frequency, the method comprising the steps of: a) providing a matching volume between, and in communication with, the acoustic driver and the acoustic load, the matching volume being substantially greater in size than a stroke volume of the acoustic driver; and b) sizing the matching volume such that, in combination with the moving mass, the characteristic stiffness of the acoustic driver and the characteristic load impedance, a resulting pressure wave produces an operating resonant frequency substantially equal to the preferred operating frequency of the load.

A second aspect of the invention is directed to a method for matching an acoustic driver to an acoustic load in a resonant acoustic system, the acoustic driver including a moving mass, a characteristic stiffness, a preferred force amplitude, and a preferred stroke; the acoustic load including a characteristic load impedance, a preferred input acoustic flow amplitude, and a preferred operating frequency, the method comprising the steps of: a) providing a matching volume between, and in communication with, the acoustic driver and the acoustic load, the matching volume being substantially greater in size than a stroke volume of the acoustic driver; and b) sizing the stroke volume of the acoustic driver such that, in combination with the moving mass, the characteristic stiffness of the acoustic driver and the characteristic load impedance, a resulting pressure wave delivers the preferred input acoustic flow amplitude to the load when the acoustic driver is operating approximately at: the operating resonant frequency, the preferred stroke, and the preferred force amplitude.

A third aspect of the invention provides a resonant acoustic system comprising: an acoustic driver including a piston, the driver having a first, stroke volume that provides space for a stroke of the piston; an acoustic load receiving an acoustic pressure wave from the driver; and a second volume between the driver and the load, the second volume being substantially greater in size than the first, stroke volume, wherein the second volume is sized such that an operating resonant frequency substantially equal to a preferred operating frequency of the acoustic load is achieved.

A fourth aspect of the invention is directed to a resonant acoustic system comprising: an acoustic driver including a piston, the driver having a first, stroke volume that provides space for a stroke of the piston; an acoustic load receiving an acoustic pressure wave from the driver; and a second volume between the driver and the load, the second volume being substantially greater in size than the first, stroke volume, wherein the stroke volume of the acoustic driver is sized such that, in combination with the moving mass, the characteristic stiffness of the acoustic driver and the characteristic load impedance, a resulting pressure wave delivers the preferred input acoustic flow amplitude to the load when the acoustic driver is operating approximately at: the operating resonant frequency, the preferred stroke, and the preferred force amplitude.

A fifth aspect of the invention is directed to a cryocooler comprising: a linear-motor driven compressor including a piston, the compressor having a first, stroke volume that provides space for a stroke of the piston; a pulse tube expander receiving an acoustic pressure wave from the compressor; and a second volume between the compressor and the expander, the second volume being substantially greater in size than the first, stroke volume, wherein the second volume is sized such that an operating resonant frequency substantially equal to a preferred operating frequency of the acoustic load is achieved.

A sixth aspect of the invention is directed to a cryocooler comprising: a linear-motor driven compressor including a piston, the compressor having a first, stroke volume that provides space for a stroke of the piston; a pulse tube expander receiving an acoustic pressure wave from the compressor; and a second volume between the compressor and the expander, the second volume being substantially greater in size than the first, stroke volume, wherein the stroke volume of the compressor is sized such that, in combination with the moving mass, the characteristic stiffness of the compressor and the characteristic load impedance, a resulting pressure wave delivers the preferred input acoustic flow amplitude to the expander when the compressor is operating approximately at: the operating resonant frequency, the preferred stroke, and the preferred force amplitude.

The foregoing and other features and advantages of the invention will be apparent from the following more particular description of preferred embodiments of the invention.

BRIEF DESCRIPTION OF THE DRAWINGS

The preferred embodiments of this invention will be described in detail, with reference to the following figures, wherein like designations denote like elements, and wherein.

DESCRIPTION OF THE PREFERRED EMBODIMENTS

I. Overview

Figure 1:
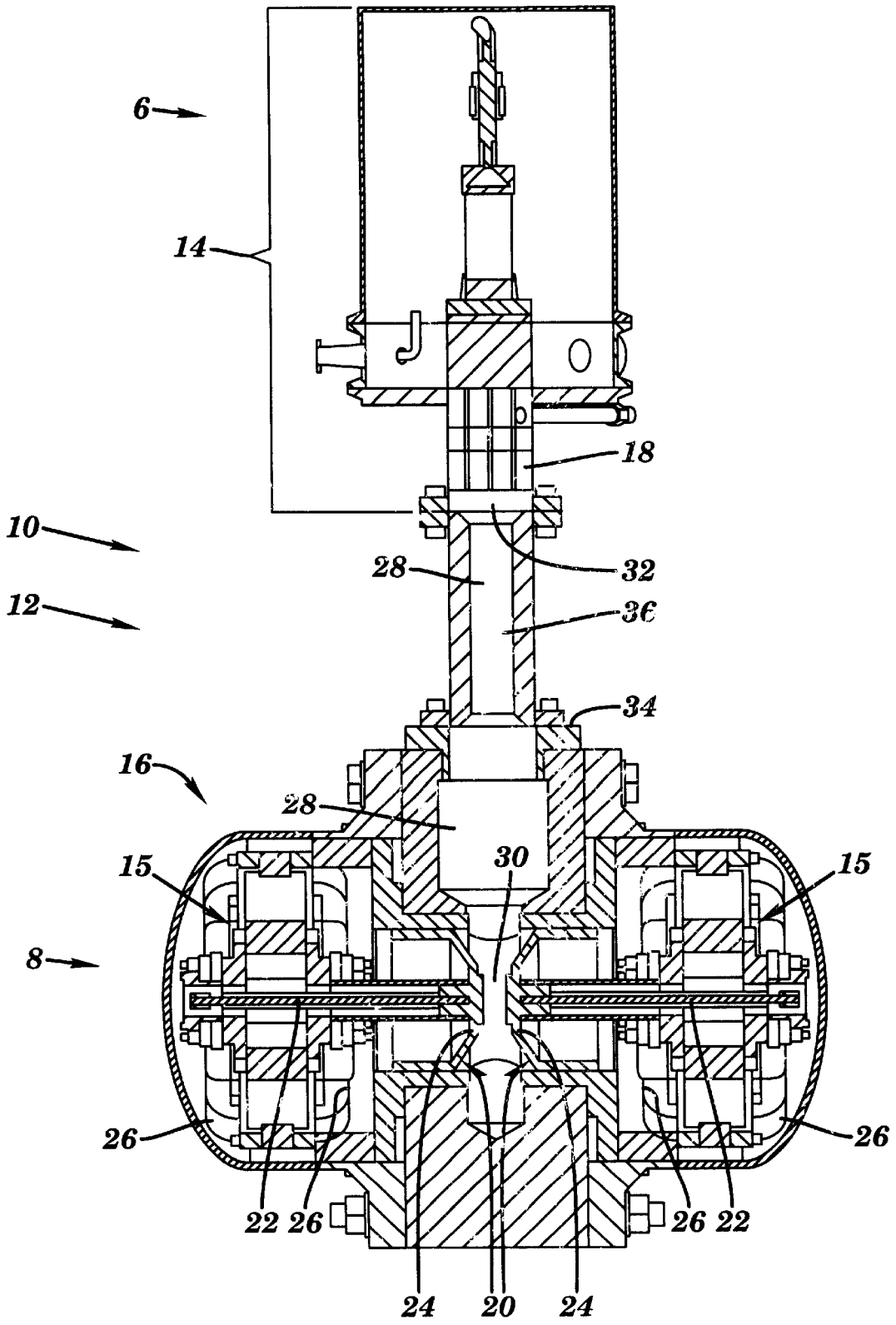
FIG. 1 shows an acoustic resonant system having a matching volume provided between the acoustic driver and the acoustic load.

Referring to FIG. 1, the invention includes a method for matching an acoustic load 6 and an acoustic driver 8 in a resonant acoustic system 10, and the acoustic system so formed. The goal is to efficiently connect, what may be independently designed acoustic drivers 8 and acoustic loads 6. The invention 10 will be described in terms of a system 10 in the form of a cryocooler 12. Cryocooler 12 has an acoustic load 6 in the form of a pulse tube expander 14 and an acoustic driver 8 in the form of at least one linear-motor 15 driven resonant pressure wave generator (PWG) or compressor 16. Load 6 receives an acoustic pressure wave from driver 8. In FIG. 1, two motors 15 forming one compressor 16 is shown. Expander 14 may include, inter alia, an aftercooler 18, a regenerator, a cold heat exchanger, a pulse tube, etc. It should be recognized that the invention is applicable to any acoustic system having an acoustic load and an acoustic driver.

There are a number of parameters that play a part in matching an acoustic driver 8 to an acoustic load 6, and an acoustic load 6 to an acoustic driver 8. Each acoustic driver 8 includes a moving mass 20 that may include, inter alia, a moving member(s) 22 and a piston(s) 24. In addition, each acoustic driver 8 has a characteristic stiffness created by, inter alia, a mechanical stiffness $k_{mech}$ of a suspension(s) 26 and stiffness due to gas pressure $k_{gas}$ acting on piston(s) 24. Other forces such as electromagnetic stiffness may also be included in the characteristic stiffness. Each acoustic driver 8 also has a preferred force amplitude, and a preferred stroke, i.e., stroke volume. Similarly, each acoustic load 6 has a characteristic load impedance, a preferred input acoustic flow amplitude, and a preferred operating frequency.

At the low fractional pressure amplitudes typical of certain acoustic systems such as pulse tube cryocoolers, acoustic driver 8 can be characterized as a first-order spring-mass system with low damping. Neglecting the damping term for simplicity, the resonant frequency of acoustic driver 8 is given by:

$$f_{res} = \frac{1}{2\pi}\sqrt{\frac{k_{tot}}{m}} \tag{1}$$

where $k_{tot}$ is the total stiffness, i.e., the sum of the mechanical stiffness of the suspension $k_{mech}$ and the stiffness due to gas pressure acting on the piston $k_{gas}$. Therefore:

$$k_{tot}=k_{gas}+k_{mech} \tag{2}$$

An electromagnetic stiffness, if present, may also be included in mechanical stiffness $k_{mech}$ for the purpose of this analysis.

In low-power acoustic drivers 8, mechanical stiffness $k_{mech}$ of the suspension can be much larger than gas stiffness $k_{gas}$, so the resonant frequency of such drivers is a weak function of acoustic load 6 impedance. However, in high-power drivers 8 (e.g., with capacities of several hundreds of watts or more), the gas stiffness $k_{gas}$ can be significantly larger than the mechanical stiffness $k_{mech}$. Accordingly, the resonant frequency of driver 8 becomes a sensitive function of the impedance of load 6. Simply achieving resonant conditions at driver 8 is therefore insufficient. For a practical machine the other "matching conditions" must also be addressed. In general, for an optimized design, all the following matching conditions must be satisfied simultaneously at full rated power: driver 8 must be operated at the design frequency of load 6, driver 8 must operate at its resonant frequency, driver 8 must deliver the proper acoustic power to load 6, driver 8 must operate at the full design stroke (i.e., stroke volume), and the values of the pressure and volumetric flow rate amplitudes and phases must be matched to a design point of load 6.

In general, for independently designed drivers 8 and loads 6, only some of these matching conditions will be satisfied, resulting in inferior performance. Depending on which parameters are considered fixed, it is likely that the design frequency for load 6 will differ from the resonant frequency of the complete system 10, or full acoustic power will be delivered at a stroke other than rated stroke. If full acoustic power is delivered at less than rated stroke, excessive driver 8 current will be required. If full rated power is delivered at more than rated stroke, the machine will be stroke-limited and never achieve its design cooling capacity.

II. Acoustic System

In order to match acoustic driver and load, the invention implements a "matching volume" 28 located between a first, stroke volume 30 and load 6. "Stroke volume" is a volume that is displaced by moving mass(es) 20 of driver 8, i.e., a volume that provides space for a stroke of the piston. In the example shown, the size of stroke volume 30 is determined by the displacement of piston(s) 24 of linear motor(s) 15. Matching volume 28 is substantially greater in size than first, stroke volume 30. The actual difference in size will vary depending on the particular driver 8 and load 6. Load 6 is considered to begin at a load opening 32. In the example shown, load opening 32 is provided at an opening of aftercooler 18. However, load opening 32 may be considered to be at any convenient starting point of load 6. By properly sizing this second matching volume 28 and/or driver piston 24 area (stroke volume) according to the method of the present invention, discussed below, it is possible to meet all the matching conditions for a wide range of drivers 8 and loads 6. This is possible despite driver 8 and load 6 being independently designed.

As will be described in more detail below, in one embodiment, matching volume 28 is sized such that a resulting pressure wave produces an operating resonant frequency substantially equal to a preferred operating frequency of acoustic load. In particular, matching volume 28 is sized such that a resulting pressure wave, acting on the face(s) of piston(s) 24, modifies the characteristic stiffness of driver 8 to produce the above-stated pressure wave. Alternatively, or in addition thereto, piston(s) 24 (stroke volume) may be sized with matching volume 28 such that, in combination with moving mass 20, the characteristic stiffness of acoustic driver 8 and a characteristic load impedance of acoustic load 6, a resulting pressure wave delivers the preferred input acoustic flow amplitude to load 6 when acoustic driver 8 is operating approximately at: the operating resonant frequency, the preferred stroke, and the preferred force amplitude.

Matching volume 28 can be provided in a number of ways. In one embodiment shown in FIG. 1, matching volume 28 is provided by at least one of a driver body insert 34 and an extension tube 36. Alteration of matching volume 28 is accomplished by, for example, changing the size of the surrounding containment(s) instead of by adjusting the independently designed driver 8 and/or load 6. For example, matching volume 28 may be adjusted in size by changing the size of at least one of driver body insert 34 and extension tube 36. Actual adjustment can be provided by any now known or later developed methods. For example the following dimensions can be adjusted: the inner diameter and length of extension tube 36, the inner diameter and length of driver body insert 34, the extent to which insert 34 extends into the driver body, etc.

One aspect of the system that results from the implementation of matching volume 28 is the use of drivers 8 with larger stroke volume-to-power ratios than conventionally used. Cryocoolers designed for use in, for example, aerospace applications, generally try to minimize this ratio in order to minimize cryocooler size and weight. However, for large cryocoolers for ground and sea-based applications, size is not typically the primary design criterion, and the invention can be used advantageously. The following paragraphs give more detail on implementation of the inventive method and techniques for sizing the matching volume and/or stroke volume.

III. Methodology

The invention includes a method for matching acoustic driver 8 to acoustic load 6 in resonant acoustic system 10 by first providing a matching volume 28 between, and in communication with, acoustic driver 8 and acoustic load 6. As stated, matching volume 28 is substantially greater in size than stroke volume 30 of acoustic driver 8.

Next, matching volume 28 is sized such that, in combination with moving mass(es) 20, the characteristic stiffness of acoustic driver 8 and the characteristic load impedance of acoustic load 6, a resulting pressure wave produces an operating resonant frequency substantially equal to the preferred operating frequency of load 6. In particular, matching volume 28 is sized such that a resulting pressure wave, acting on the face(s) of piston(s) 24, modifies the characteristic stiffness of driver 8 to produce the above-stated pressure wave. Alternatively, or in addition thereto, stroke volume 30 of acoustic driver 8 may be sized such that, in combination with moving mass(es) 20, the characteristic stiffness and the characteristic load impedance, the resulting pressure wave delivers the preferred input acoustic flow amplitude to load 6 when driver 8 is operating approximately at: the operating resonant frequency, the preferred stroke, and the preferred force amplitude. Alteration of the above-stated volumes may be accomplished by, for example, changing the size of the surrounding containment(s) other than by adjusting the independently designed driver 8 and/or load 6.

One embodiment of implementing the above-identified method is described algorithmically below. It should be recognized, however, that the algorithm described provides an approximation. Iteration of the algorithm may lead to a more accurate outcome.

The matching volume sizing problem can be approached from several different perspectives, depending on whether the task is to determine load 6 operating conditions for a given driver 8, or to size a driver 8 to efficiently drive a given load 6. These two cases are described below.

A. Given Driver Geometry, Find Pressure Amplitude

In one embodiment, pressure amplitude for a given driver geometry can be found. That is, for a given driver 8 geometry, the sizing problem can be stated as: What size matching volume 28 and what pressure amplitude and phase (relative to piston motion or consequent gas flow) are required in order to satisfy the matching conditions (i.e., pressure, flow and relative phase) at load opening 32?

We take the following values as given for driver 8: $P_{mean}$, $\gamma$, A, $V_{backside}$, m, $|x|$, $f_{res}$, and $k_{mech}$. $P_{mean}$ is the mean pressure in system 10, $\gamma$ is the ratio of specific heats, A is piston(s) 24 area, $V_{backside}$ is the volume of the backside of piston(s) 24, m is the mass of driver 8 moving mass 20, $|x|$ is the piston stroke amplitude, $f_{res}$ is (operating) resonant frequency, and $k_{mech}$ is mechanical stiffness, as described above.

With these inputs, we can write:

$$k_{tot}=(2\pi f_{res})^2 m \tag{3}$$

The compressible fluid (gas) stiffness can be written as:

$$k_{gas}=k_{front}+k_{back} \tag{4}$$

where $k_{front}$ is the stiffness due to forces on the front side of piston(s) 24, and $k_{back}$ is the stiffness due to the forces on the back side of piston(s) 24. So:

$$\begin{aligned} k_{front} &= k_{tot} - k_{back} - k_{mech} \\ &= (2\pi f_{res})^2 m - \frac{A^2 p_{mean}\gamma}{V_{backside}} - k_{mech} \end{aligned} \tag{5}$$

and $$|p| = \frac{k_{front}|x|}{A\sin\theta} \tag{6}$$

so the amplitude of the complex pressure at piston(s) 24 face(s) is given by:

$$|p| = \left[(2\pi f_{res})^2 m - \frac{A^2 p_{mean}\gamma}{V_{backside}} - k_{mech}\right]\frac{|x|}{A\sin\theta} \tag{7}$$

This value of the complex pressure p will allow driver 8 to operate at resonant conditions with the given geometry, mean pressure and stroke.

To satisfy the remaining power matching conditions, the phase angle $\theta$ between the pressure and the volumetric flow rate U must be determined. Phase angle $\theta$ can be obtained from the relationship for acoustic power at the face(s) of piston(s) 24:

$$\dot{W} = \frac{1}{2}|p||U|\cos\theta \tag{8}$$

In the above equation, p is the complex pressure $p=p_1e^{i\omega t}$, where ω is the angular frequency of operation. The subscript designation 1 represents the condition at piston(s) 24 face(s).

Solving Eq. (8) for phase angle θ yields a second equation to be satisfied:

$$\theta = \arccos\left(2\frac{\dot{W}}{|p||U|}\right) \tag{9}$$

To size matching volume 28, equations (7) and (9) are solved together. In one embodiment, this is accomplished using an iterative procedure. Beginning with a guess for phase angle θ, we use Eq. (7) to calculate pressure amplitude p in first volume 30. This value is inserted into Eq. (9), yielding a second estimate of phase angle θ. A new guess for phase angle θ is then made, and the two equations are solved iteratively for pressure amplitude p and phase angle θ. These results give the complex pressure and volumetric flow rate at piston(s) 24 face(s).

The final step in sizing matching volume 12 is to determine the volume required between first volume 30 and load opening 32 in order to obtain the correct pressure-flow-phase relationship at load 6. Here we use the relationship for the change in volumetric flow rate across an open volume V:

$$\Delta U = \frac{-i\omega V p}{\gamma p_{mean}} \tag{10}$$

U is known from the piston motion and phase angle θ. If we designate the conditions at the piston(s) 24 as $U_1$, then the required flow condition at load opening 32, $U_2$, is given by:

$$U_2 = U_1 + \Delta U \tag{11}$$

The subscript designation 1 represents the condition at piston(s) 24 face(s), and designation 2 represents the condition at load opening 32. Since the extent of matching volume 28 is much less than an acoustic wavelength, the pressure amplitude and phase will change by a negligible amount across matching volume 28. The conditions at load opening 32 are then given by p and $U_2$.

In view of foregoing, the size of matching volume 28 can be solved by restating equation (10) as:

$$V = \Delta U\left[\frac{\gamma p_{mean}}{-i\omega p}\right] \tag{12}$$

B. Know Desired Pressure Amplitude, Find Piston Area

In an alternative embodiment, moving mass(es) 20/piston(s) 24 face area (stroke volume) can be found for a given load 6. That is, for the case where the desired load pressure amplitude, p, is known, the above procedure can be rearranged to yield expressions for the required piston(s) 24 face area and, therefore, stroke volume at a desired stroke. Rearranging Eq. (7) yields the following quadratic equation for piston(s) 24 area:

$$\frac{A^2 p_{mean}\gamma}{V_{backside}} + \frac{|p|A\sin\theta}{|x|} + k_{mech} - (2\pi f_{res})^2 m = 0 \tag{13}$$

Similar to the previous case, Eq. (9) and Eq. (13) are solved together, but now for area A (and stroke volume) and phase angle θ, instead of pressure amplitude p and phase angle θ. Eq. (10) and (11) or (12) are used to determine matching volume 28 size necessary to give the desired pressure amplitude p and volumetric flow $U_2$ at load opening 32.

This alternative embodiment may be provided independently of the earlier embodiment or in combination therewith.

In the above description, certain values were assumed constant. For example, the mean pressure ($p_{mean}$) in system 10, the ratio of specific heats (γ), piston(s) 24 area A, the volume of the backside of piston(s) 24 ($V_{backside}$), the mass of driver 8 moving mass 20 (m), the piston stroke amplitude |x|, operating resonant frequency $f_{res}$, and mechanical stiffness $k_{mech}$ were indicated as being constants. Alteration of volumes, therefore, is accomplished by, for example, changing the size of the surrounding containment(s) other than by adjusting driver 8 and/or load 6. However, it should be recognized that where alteration of driver and/or load values is possible, this may occur in conjunction with the above methodology in order to achieve the matching conditions. One exemplary value that may be changed in some circumstances is moving mass 20 of driver 8, e.g., by changing the size of piston(s) 24.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A resonant acoustic system comprising:

an acoustic driver including a piston, the driver having a first, stroke volume that provides space for a stroke of the piston;

an acoustic load receiving an acoustic pressure wave from the driver; and a second volume between the driver and the load, the second volume being substantially greater in size than the first, stroke volume, wherein the second volume is sized such that an operating resonant frequency substantially equal to a preferred operating frequency of the acoustic load is achieved.

2. The system of claim 1, wherein the first, stroke volume is sized such that, in combination with a characteristic stiffness of the acoustic driver and a characteristic load impedance of the acoustic load, a resulting pressure wave delivers a preferred input acoustic flow amplitude to the load when the acoustic driver is operating approximately at: the operating resonant frequency, a preferred stroke, and a preferred force amplitude.

3. The system of claim 2, wherein the size of the stroke volume is adjusted by changing a face area of the piston.

4. The system of claim 1, wherein the driver includes two pistons.

5. The system of claim 1, wherein the second volume is provided by at least one of an extension tube coupled to the driver and a driver body insert.

6. The system of claim 1, wherein the second volume is adjustable by changing a size of at least one of the extension tube and the driver body insert.

7. A resonant acoustic system comprising:

an acoustic driver including a piston, the driver having a first, stroke volume that provides space for a stroke of the piston;

an acoustic load receiving an acoustic pressure wave from the driver; and a second volume between the driver and the load, the second volume being substantially greater in size than the first, stroke volume, wherein the stroke volume of the acoustic driver is sized such that, in combination with the moving mass, the characteristic stiffness of the acoustic driver and the characteristic load impedance, a resulting pressure wave delivers the preferred input acoustic flow amplitude to the load when the acoustic driver is operating approximately at: the operating resonant frequency, the preferred stroke, and the preferred force amplitude.

8. The system of claim 7, wherein the second volume is sized such that, in combination with the moving mass, the characteristic stiffness of the acoustic driver and the characteristic load impedance, the resulting pressure wave produces an operating resonant frequency substantially equal to the preferred operating frequency of the load.

9. A cryocooler comprising:

a linear-motor driven compressor including a piston, the compressor having a first, stroke volume that provides space for a stroke of the piston;

a pulse tube expander receiving an acoustic pressure wave from the compressor; and a second volume between the compressor and the expander, the second volume being substantially greater in size than the first, stroke volume, wherein the second volume is sized such that an operating resonant frequency substantially equal to a preferred operating frequency of the expander is achieved.

10. The cryocooler of claim 9, wherein the first, stroke volume is sized such that, in combination with a characteristic stiffness of the compressor and a characteristic load impedance of the expander, a resulting pressure wave delivers a preferred input acoustic flow amplitude to the expander when the compressor is operating approximately at: the operating resonant frequency, a preferred stroke, and a preferred force amplitude.

11. The system of claim 10, wherein the size of the stroke volume is adjusted by changing a face area of the piston.

12. The cryocooler of claim 9, wherein the compressor includes two pistons.

13. The cryocooler of claim 9, wherein the second volume is provided by at least one of an extension tube coupled to the compressor and a compressor body insert.

14. The cryocooler of claim 9, wherein the second volume is adjustable by changing a size of at least one of the extension tube and the driver body insert.

15. A cryocooler comprising:

a linear-motor driven compressor including a piston, the compressor having a first, stroke volume that provides space for a stroke of the piston;

a pulse tube expander receiving an acoustic pressure wave from the compressor; and a second volume between the compressor and the expander, the second volume being substantially greater in size than the first, stroke volume, wherein the stroke volume of the compressor is sized such that, in combination with the moving mass, the characteristic stiffness of the compressor and the characteristic load impedance, a resulting pressure wave delivers the preferred input acoustic flow amplitude to the expander when the compressor is operating approximately at: the operating resonant frequency, the preferred stroke, and the preferred force amplitude.

16. The cryocooler of claim 15, wherein the second volume is sized such that, in combination with the moving mass, the characteristic stiffness of the compressor and the characteristic load impedance, the resulting pressure wave produces an operating resonant frequency substantially equal to the preferred operating frequency of the load.

17. The cryocooler of claim 15, wherein the size of the stroke volume is adjusted by changing a face area of the piston.

18. The cryocooler of claim 15, wherein the compressor includes two pistons.

19. The cryocooler of claim 15, wherein the second volume is provided by at least one of an extension tube coupled to the compressor and a compressor body insert.

20. The cryocooler of claim 15, wherein the second volume is adjustable by changing a size of at least one of the extension tube and the driver body insert.

* * * * *